US005622225A

United States Patent [19]

Sundholm

[11] Patent Number: 5,622,225

[45] Date of Patent: Apr. 22, 1997

[54] QUICK RESPONSE SPRINKLER HEAD

[76] Inventor: Göran Sundholm, Ilmari Kiannon kuja 3, FIN-04310 Tuusula, Finland

[21] Appl. No.: 318,816

[22] PCT Filed: Apr. 21, 1993

[86] PCT No.: PCT/FI93/00164

§ 371 Date: Dec. 12, 1994

§ 102(e) Date: Dec. 12, 1994

[87] PCT Pub. No.: WO93/21998

PCT Pub. Date: Nov. 11, 1993

[30] Foreign Application Priority Data

Apr. 23, 1992 [FI] Finland ..... 921806

[51] Int. Cl.[6] ..... A62C 37/14

[52] U.S. Cl. ..... 169/61; 169/38

[58] Field of Search ..... 169/37, 38, 39, 169/40, 41, 90, 60, 61

[56] References Cited

U.S. PATENT DOCUMENTS

| | | | |
|---|---|---|---|
| 1,392,593 | 10/1921 | Newton | 169/38 |
| 2,245,144 | 6/1941 | Griffith | 169/37 |
| 3,726,344 | 4/1973 | Rothman et al. | 169/37 |
| 4,596,483 | 6/1986 | Gabriël | 403/28 |
| 5,361,847 | 11/1994 | Phelps | 169/61 X |

FOREIGN PATENT DOCUMENTS

| | | | |
|---|---|---|---|
| 2118399 | 7/1972 | France . | |
| 3814043 | 11/1989 | Germany . | |
| 12914 | 6/1903 | United Kingdom | 169/38 |

*Primary Examiner*—Andrew C. Pike
*Attorney, Agent, or Firm*—Ladas & Parry

[57] ABSTRACT

Fire-fighting equipment has a release device (7) arranged to be activated at a predetermined release temperature, and an element (8) of memory metal immediately close to the release device and arranged to change shape at a predetermined memory temperature to close an electric circuit (10-9-8-5-2-11) for heating the memory metal element (8) and, thereby, the release device to the release temperature, whereby to effect a fast release action.

9 Claims, 2 Drawing Sheets

QUICK RESPONSE SPRINKLER HEAD

BACKGROUND OF THE INVENTION

The present invention relates to fire fighting equipment having a release device that is activated at a predetermined release temperature. The release device may be, e.g., a glass ampoule or a fuse, which breaks or melts, respectively, at the predetermined release temperature and thereby releases, i.e., activates, a spray head to spray extinguishing liquid.

The nominal release temperature may be, e.g., about 70° C. Usual release elements are, however, heated up to the release temperature rather slowly. At a fire in a hotel room or in a ship cabin, for example, the temperature in the room or cabin has time to rise to some 300° C.–400° C. before release takes place in conventional sprinkler installations.

Recent so-called fast response sprinklers are, in similar situations, capable of release at a room or cabin temperature of about 200° C.–250° C. A measure of the release rate generally used is a so-called Response Time Index (RTI). Conventional sprinklers have a Response Time Index of about 300; the "fast" sprinklers mentioned above have a Response Time Index of about 50.

SUMMARY OF THE INVENTION

The object of the present invention is to provide new fire fighting equipment which is released considerably faster than earlier known designs.

The fire fighting equipment according to the invention is mainly characterized in that an element of memory metal is immediately close to the release device. The element of memory metal changes shape at a predetermined memory temperature to close an electric circuit for heating the memory metal element and, thereby, the device means to effect its fast release action. As used herein, therefore, "immediately close" means sufficiently close for the element of memory metal to heat the release device.

The element of memory metal is preferably a wire helically laid around the release device.

The memory metal can preferably be a NiTi-alloy with a memory temperature of about 70° C.

At a certain predeterminable memory temperature such a memory metal wire takes a previously "taught" shape. At lower temperatures the wire can be deformed practically at will without mentionable mechanical resistance.

Thus, a helical spring can be "taught" to "remember" a certain length at a temperature of about 70° C. Thereafter the spring can be compressed at, e.g., room temperature to another length, which it retains until the temperature of the spring rises to the memory temperature, whereupon the spring returns to its "taught" length.

In the present invention this property is utilized for closing an electric circuit at the memory temperature, preferably by making contact to suitable metal parts of a sprinkler included in the electric circuit.

The wire of memory metal can be thin, with a diameter of, e.g., 0.3 mm, whereby it is rapidly heated by surrounding hot smoke gases from a fire. When it them establishes a conducting connection, the memory metal wire immediately heats up further and conveys its heat to the release device formed, e.g., by a conventional glass ampoule which is broken in about two seconds.

Thanks to the invention, a Response Time Index of less than 10 can be achieved which, in the fire situations earlier referred to, results in extinguisher release at a room or cabin temperature of less than 100° C. This means that fires are fought in their initial stage and the generation of poisonous smoke gases can be decisively restricted.

BRIEF DESCRIPTION OF THE DRAWING

In the following the invention will be described with reference to the attached drawing which, by way of example, shows a preferred embodiment.

DESCRIPTION OF THE PREFERRED EMBODIMENT

Figure 1:
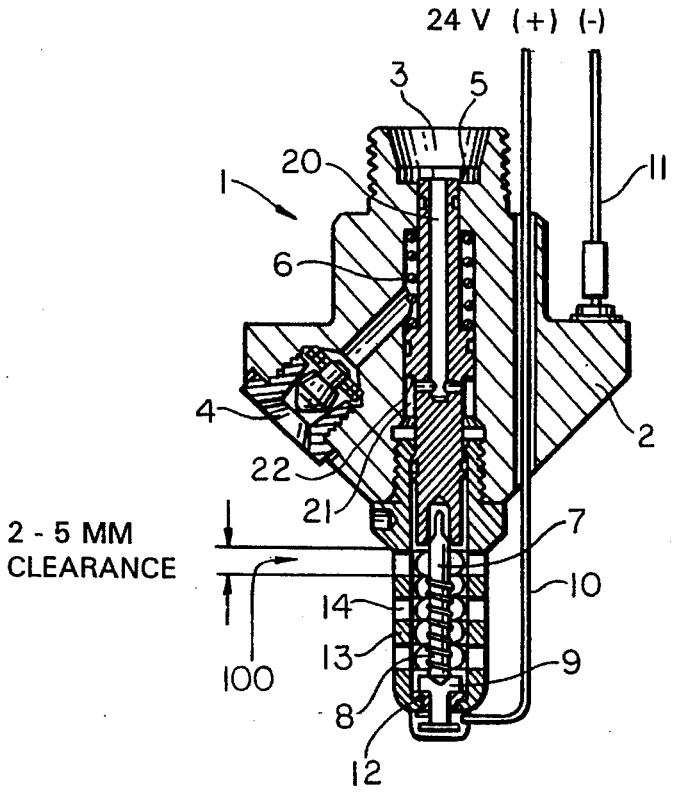
FIG. 1 shows a section of a sprinkler with a helical spring of memory metal around a release device at normal temperature.

In the drawing, reference numeral 1 generally indicates a sprinkler the housing of which is indicated by 2. The sprinkler has a liquid inlet 3 and a number of nozzles 4 (only one shown).

A spindle 5 extends from an end in the inlet 3 along a central bore in the housing 2. A spring 6 supported by a shoulder in the housing 2 presses the spindle against a release device 7 which is, e.g., a conventional glass ampoule.

At normal temperature the ampoule 7 withstands the mechanical load exerted by the spring 6 through the spindle 5, and the end (the upper end in the drawing) of the spindle thus held in the inlet 3 closes a connection from the inlet 3 to the nozzles 4, as shown in FIG. 1.

Figure 3:
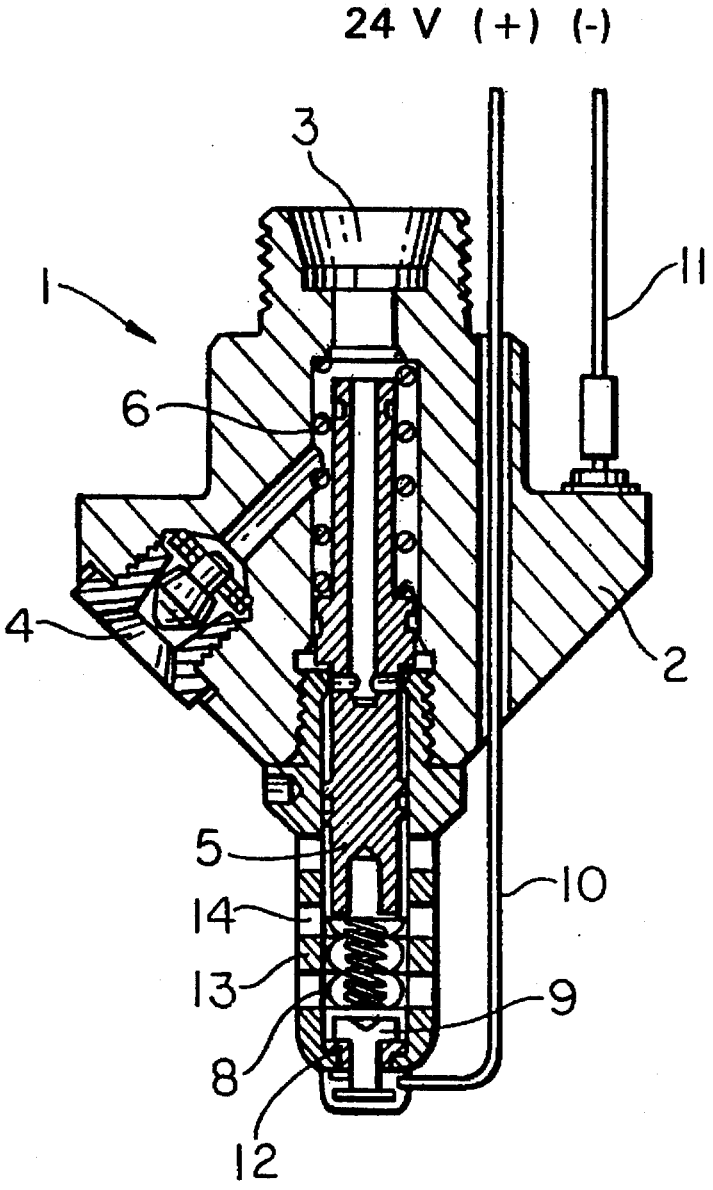
FIG. 3 shows the section of the sprinkler in an activated state.

At a raised, release temperature, generally about 70° C., the ampoule 7 is demolished and this allows the spring 6 to push the spindle axially to the position shown in FIG. 3, which opens the connection from the liquid inlet 3 to the nozzles 4.

Around the ampoule 7 is laid a spiral of memory metal 8. At normal temperature, as shown in FIG. 1, the spiral remains as it was compressed so that there is a gap 100 of, e.g., 2–5 mm between one of its ends (the upper end in the drawing) and the adjacent, lower end of the spindle 5. The opposite, lower end of the spiral 8 is in contact with an electrically conducting support 9 for the ampoule 7. The support 9 is connected to one terminal 10 of an electric circuit having a voltage of preferably about 24 Volt. The second terminal 11 of the circuit is connected to the housing 2 of the sprinkler 1. An insulation piece 12 is provided between the support 9 and a usually metallic casing 13 surrounding the ampoule 7 and having a number of apertures 14.

Figure 2:
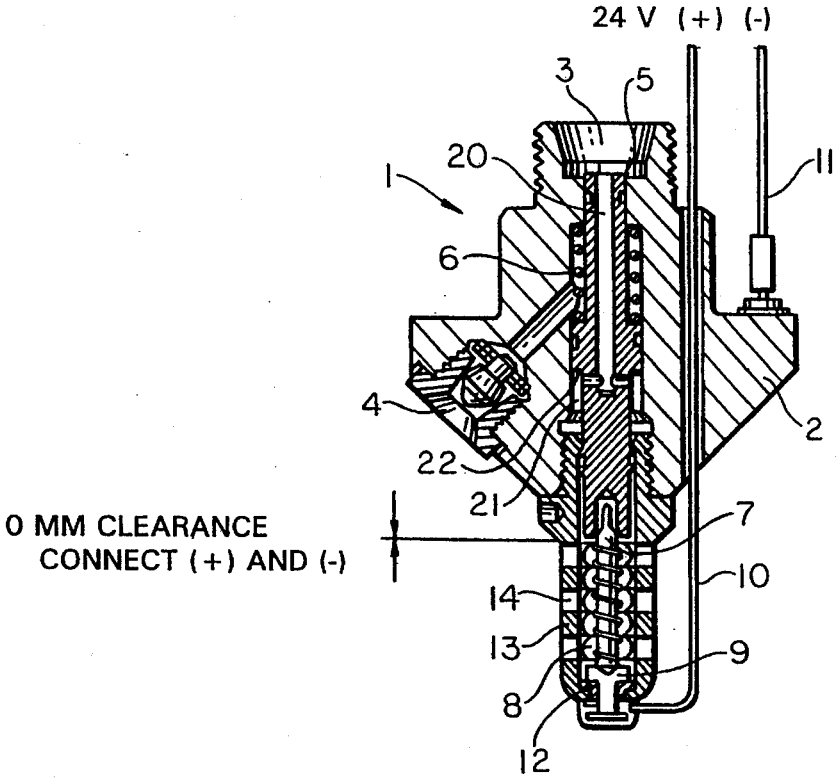
FIG. 2 shows the section of the sprinkler in an initial stage at a raised temperature.

If a fire breaks out within the area monitored by the sprinkler, the spiral 8 is rapidly heated by surrounding smoke gases and upon reaching the memory temperature, e.g., about 70° C., the spiral 8 immediately straightens out to a preset, "taught" length which is so chosen that the spiral 8 is pressed into contact against the adjacent end of the spindle 5 thus closing the electric unit 10-9-8-5-(6)-2-11, FIG. 2. The spiral 8 now acts as a heating coil and rapidly heats the ampoule 7 to the release temperature. A current of about one ampere through the spiral 8 is capable of releasing the ampoule 7 in about two seconds. At normal temperature the spiral 8 need not be in contact with the support 9; there can be a gap. A wire of a NiTi-alloy and having a diameter of, e.g., 0.3 mm is of advantage in that it has a favorable electric resistance; those parts of the spray head which are included in the electric circuit have practically no resistance.

The drawing shows a sprinkler intended for a high operating pressure and with nozzles arranged in such a way that they can produce a continuous fog spray with a good penetration power, preferably as presented in the international patent applications PCT/FI92/00060 (i.e., publication WO92/15370) and PCT/FI92/00155 (i.e., publication WO92/20453) respectively, but the invention can naturally be used for other types of sprinklers, as well as for other temperature activating elements.

As will appear from the drawing, the sprinkler 1 preferably comprises a spindle structure with an axially movable spindle 5 loaded by a spring 6 against the release ampoule 7 and having an axial channel 20 leading to an annular chamber 21 with an end face 22 which balances the liquid pressure force acting through the inlet 3 on the spindle end; the end face 22 has an area equal to the one of the spindle end at the inlet 3.

In FIG. 1, the sprinkler is inactive, i.e., the ampoule 7 is intact and there is no connection from the inlet 3 to the nozzles 4. In FIG. 3, the ampoule 7 has been broken, the spring 6 has pressed the spindle 5 downwards to make free a connection from the inlet 3 to respective side channels leading to the nozzles 4.

When the release means is an ampoule like the one shown in the drawing, a surrounding spiral is preferable, but if the release means is, e.g., a fuse intended to melt the element of memory metal may be of another shape suitable for the case.

An additional advantage of the equipment according to the invention is that it can be used as a heat detector, e.g., for a fire alarm (not shown). When the electric circuit closes, an electric signal is conveniently obtained for that purpose. Separate heat detectors are no longer necessary.

I claim:

1. Fire-fighting equipment comprising a release means (7) arranged to be activated at a predetermined release temperature, and an element (8) of memory metal immediately close to the release means (7) and arranged to change shape at a predetermined memory temperature to close an electric circuit (10-9-8-5-2-11) for heating the memory metal element (8) and, thereby, the release means (7) to the release temperature, whereby to effect a fast release action.

2. Fire fighting equipment according to claim 1, wherein the element of memory metal is a wire (8) helically laid around the release means (7).

3. Fire-fighting equipment according to claim 1, wherein the element (8) of memory metal is arranged to close the electric circuit (10-9-8-5-2-11) by making contact with conductive parts (5; 9) of a sprinkler (1) included in the electric circuit.

4. In fire-fighting equipment having release means (7) for release of fire-fighting activity at a first predetermined temperature, the improvement comprising:

an element (8) immediately close to the release means (7) and responsive to a second predetermined temperature for heating the release means (7) to the first predetermined temperature, whereby to effect a fast release action, wherein the element is a memory metal that changes shape at the second predetermined temperature, and wherein the heating heats the element (8) for the heating of the immediately close release means (7).

5. The fire-fighting equipment according to claim 4, wherein the first and second predetermined temperatures are the same.

6. In fire-fighting equipment having release means (7) for release of fire-fighting activity at a first predetermined temperature, the improvement comprising:

an element (8) immediately close to the release means (7) and responsive to a second predetermined temperature for heating the release means (7) to the first predetermined temperature, whereby to effect a fast release action, wherein the element closes an electric circuit (10-9-8-5-2-11) for the heating, and wherein the heating heats the element (8) for heating of the immediately close release means (7).

7. The fire-fighting equipment according to claim 6, wherein the first and second predetermined temperatures are the same.

8. The fire-fighting equipment having release means (7) for release of fire-fighting activity at a first predetermined temperature, the improvement comprising:

an element (8) immediately close to the release means (7) and responsive to a second predetermined temperature for heating the release means (7) to the first predetermined temperature, whereby to effect a fast release action, wherein the element is a memory metal that changes shape at the second predetermined temperature, wherein the element closes an electric circuit (10-9-8-5-2-11) for the heating, and wherein the heating heats the element (8) for the heating of the immediately close release means (7).

9. The fire-fighting equipment according to claim 8, wherein the first and second predetermined temperatures are the same.

* * * * *